US007302201B2

(12) United States Patent
Park

(10) Patent No.: US 7,302,201 B2
(45) Date of Patent: Nov. 27, 2007

(54) VOLTAGE SWITCH AND ELECTROPHOTOGRAPHIC COLOR IMAGE FORMING APPARATUS USING THE SAME

(75) Inventor: Jae-sung Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 144 days.

(21) Appl. No.: 11/175,188

(22) Filed: Jul. 7, 2005

(65) Prior Publication Data

US 2006/0078347 A1 Apr. 13, 2006

(30) Foreign Application Priority Data

Sep. 30, 2004 (KR) ..... 10-2004-0077722

(51) Int. Cl.
*G03G 15/01* (2006.01)

(52) U.S. Cl. ..... 399/90; 399/228

(58) Field of Classification Search ..... 399/90, 399/88, 223, 226, 227, 228
See application file for complete search history.

(56) References Cited

U.S. PATENT DOCUMENTS 5,276,479 A * 1/1994 Inomata ..... 399/112
5,376,998 A 12/1994 Suzuki
5,521,693 A * 5/1996 Kojima et al. ..... 399/228
5,761,576 A * 6/1998 Sugihara et al. ..... 399/90
2003/0228169 A1* 12/2003 Yoo ..... 399/88
2005/0047815 A1* 3/2005 Doi et al. ..... 399/90
2005/0053391 A1* 3/2005 Ahn et al. ..... 399/90

FOREIGN PATENT DOCUMENTS

JP 04-043372 2/1992
JP 09-325556 12/1997
JP 10-90968 A * 4/1998
KR 10-2004-0028478 A 4/2004
KR 10-2004-0032261 A 4/2004

* cited by examiner

*Primary Examiner*—Sophia S. Chen
(74) *Attorney, Agent, or Firm*—Roylance, Abrams, Berdo & Goodman, LLP

(57) ABSTRACT

A voltage switch for connecting a power supply with a plurality of development units in sequence, and an electrophotographic color image forming apparatus using the voltage switch. In the voltage switch, a first terminal is arranged on a circuit board and is connected to the power supply, and a plurality of second terminals are arranged in a circle on the circuit board and are connected with the plurality of development units, respectively. A rotor is rotatably coupled with the circuit board of the switch and is provided with a lead, such that as the rotor rotates about the circle, the first terminal can be electrically connected with the plurality of second terminals in sequence.

20 Claims, 5 Drawing Sheets

VOLTAGE SWITCH AND ELECTROPHOTOGRAPHIC COLOR IMAGE FORMING APPARATUS USING THE SAME

CROSS-REFERENCE TO RELATED APPLICATIONS

This application claims the benefit of Korean Patent Application No. 10-2004-0077722, filed in the Korean Intellectual Property Office on Sep. 30, 2004, the entire disclosure of which is incorporated herein by reference.

BACKGROUND OF THE INVENTION

1. Field of the Invention

The present invention relates to an electrophotographic color image forming apparatus. More particularly, the present invention relates to a voltage switch of an electrophotographic color image forming apparatus wherein the voltage switch can sequentially apply a development voltage to each color development unit, such that each of the color development units can apply its toner to an electrostatic latent image of a photoconductor for developing the latent image.

2. Description of the Related Art

An electrophotographic image forming apparatus is a device in which an electrostatic latent image is formed on an outer circumference of a photoconductor charged to a predetermined electric potential by scanning light onto the photoconductor. A toner which is a developing agent is applied onto the electrostatic latent image and is developed as a black-and-white or color image, and the image is then transferred and fixed onto a paper so that an image is printed. A typical electrophotographic image forming apparatus capable of color printing includes a light scanning unit for emitting light beams that correspond to an image data, a photoconductor on which the emitted light beams are projected to form an electrostatic latent image, and four development units having yellow (Y), magenta (M), cyan (C), and black (K) toners, respectively, to apply these toners to the electrostatic latent image of the photoconductor for developing the latent image into a visible toner image.

During the developing by the development units, the four kinds of toners can be applied from the development units to the photoconductor by a force resulting from a potential difference between the development units and the photoconductor. To form the potential difference, a high voltage must be applied to the four development units in sequence.

FIG. 1 is a schematic view of a conventional voltage switch of an electrophotographic color image forming apparatus.

Referring to FIG. 1, a voltage switch 10 includes a solenoid 12 and a circuit board 20. The circuit board 20 includes a first terminal 21 connected to a power supply 1 for supplying high voltages up to 3 kV, a second terminal 22 connected to a cyan development unit 5C containing a cyan (C) toner, and a leaf spring 17 having ends 17*a* and 17*b*, the end 17*a* being fixed to the circuit board 20 for an electrical connection with the second terminal 22 and the other end 17*b* being spaced apart from the first terminal 21 but being capable of contacting the first terminal 21.

The solenoid 12 is securely installed to the circuit board 20 by a bracket 15 and is provided at one end with a holder 13 that is coupled with the end 17*b* of the leaf spring 17. Though the four development units containing the yellow (Y), magenta (M), cyan (C), and black (K) toners, require four solenoids, only the solenoid 12 for the cyan development unit 5C is illustrated in FIG. 1 as an example, and the remaining solenoids each have substantially the same structure.

When the solenoid 12 of the voltage switch 10 is switched on, the holder 13 coupled with the end 17*b*, moves toward the first terminal 21 such that the end 17*b* comes into contact with the first terminal 21. The power supply 1 supplies power to the first terminal 21 such that a development bias voltage is applied to the cyan development unit 5C to cause a potential difference between the cyan development unit 5C and the photoconductor (not shown). The potential difference ensures that the cyan (C) toner can move from the cyan development unit 5C to the photoconductor for developing a cyan (C) toner image. When the solenoid 12 is off and the power supply 1 is off, the developing of the cyan (C) toner image is completed. In the same manner, each solenoid provided for the magenta (M), yellow (Y), and black (K) development units, is sequentially operated to supply power from the power supply 1 to the development units.

However, the voltage switch 10 of the conventional electrophotographic color image forming apparatus is not suitable for a small color image forming apparatus because of its size. Though there are other types of conventional voltage switches using a relay or a solid stator instead of the solenoid, these kinds of voltage switches cannot be used at a high voltage of about 3 kV. Further, conventional voltage switches that can be used at high voltages are too big and expensive to be used in a small-sized, low-priced color image forming apparatus.

Accordingly, a need exists for a system and method for providing a lower cost, smaller sized voltage switch that can operate safely at higher voltages.

SUMMARY OF THE INVENTION

The present invention provides a voltage switch requiring a smaller space for installation owing to its small size, and an electrophotographic color image forming apparatus using the voltage switch.

According to an aspect of the present invention, a voltage switch is provided comprising a first terminal connected to a power supply, a plurality of second terminals arranged in a circle and connected with a plurality of development units, respectively, wherein each of the plurality of development units holds a different color toner, and a rotor for rotating about the circle to allow the first terminal to be electrically connected with the plurality of second terminals in sequence.

The rotor can comprise a lead to connect the first terminal and the plurality of second terminals, wherein the lead comprises a ring-shaped portion being in contact with the first terminal regardless of the rotation of the rotor, and a linear portion connected with the ring-shaped portion to contact the second terminals in sequence by the rotation of the rotor.

The voltage switch can comprise a step motor to drive the rotor.

The voltage switch can also comprise a sensing element to detect an angular displacement of the rotor.

The voltage switch can further comprise a stopping element to stop the rotation of the rotor when the first terminal and any one of the second terminals are connected.

The first terminal and the plurality of second terminals can be sufficiently spaced apart from one another to prevent a leakage (that is, sparking, arcing or any other undesired conductance), of electricity.

The voltage switch can still further comprise a motor to drive the rotor, wherein the motor is sufficiently spaced apart from the first terminal and the plurality of second terminals to prevent a leakage of electricity.

The sensing element can comprise a sensor, wherein the sensor is sufficiently spaced apart from the first terminal and the plurality of second terminals to prevent a leakage of electricity.

According to another aspect of the present invention, an electrophotographic color image forming apparatus is provided comprising a photoconductor on which an electrostatic latent image is formed, a plurality of development units each containing different color toner to apply the toner to the photoconductor in order to develop a visible toner image, a power supply for supplying development voltages to the plurality of development units, and a voltage switch for connecting the power supply with the plurality of development units in sequence. The voltage switch comprises a first terminal connected to the power supply, a plurality of second terminals arranged in a circle and connected with the plurality of development units, respectively, wherein each of the plurality of development units holds a different color toner, and a rotor for rotating about the circle to allow the first terminal to be electrically connected with the plurality of second terminals in sequence.

The rotor can comprise a lead to connect the first terminal and the plurality of second terminals, wherein the lead comprises a ring-shaped portion being in contact with the first terminal regardless of the rotation of the rotor, and a linear portion connected with the ring-shaped portion to contact the second terminals in sequence by the rotation of the rotor.

The voltage switch can comprise a step motor to drive the rotor.

The voltage switch can also comprise a sensing element to detect an angular displacement of the rotor.

The voltage switch can further comprise a stopping element to stop the rotation of the rotor when the first terminal and any one of the second terminals are connected.

The first terminal and the plurality of second terminals can be sufficiently spaced apart from one another to prevent a leakage of electricity.

The voltage switch can still further comprise a motor to drive the rotor, wherein the motor is sufficiently spaced apart from the first terminal and the plurality of second terminals to prevent a leakage of electricity.

The sensing element can comprise a sensor, wherein the sensor is sufficiently spaced apart from the first terminal and the plurality of second terminals to prevent a leakage of electricity.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF THE EXEMPLARY EMBODIMENTS

A voltage switch and an electrophotographic color image forming apparatus using the same will now be described in greater detail with reference to the accompanying drawings, in which exemplary embodiments of the present invention are shown.

Figure 1:
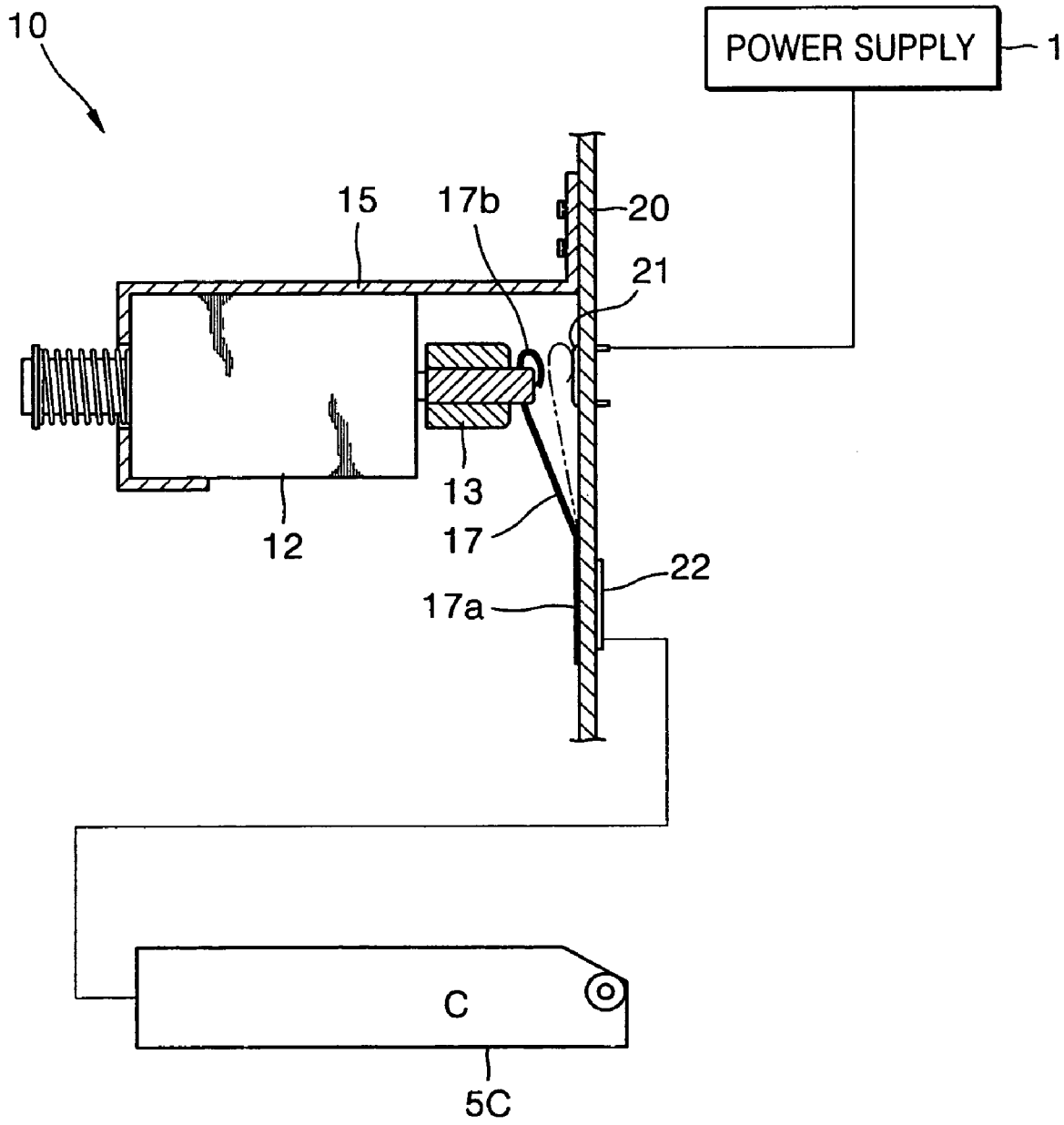
FIG. 1 (Prior Art)
FIG. 1 is a schematic view of a conventional voltage switch of an electrophotographic color image forming apparatus.
Figure 2:
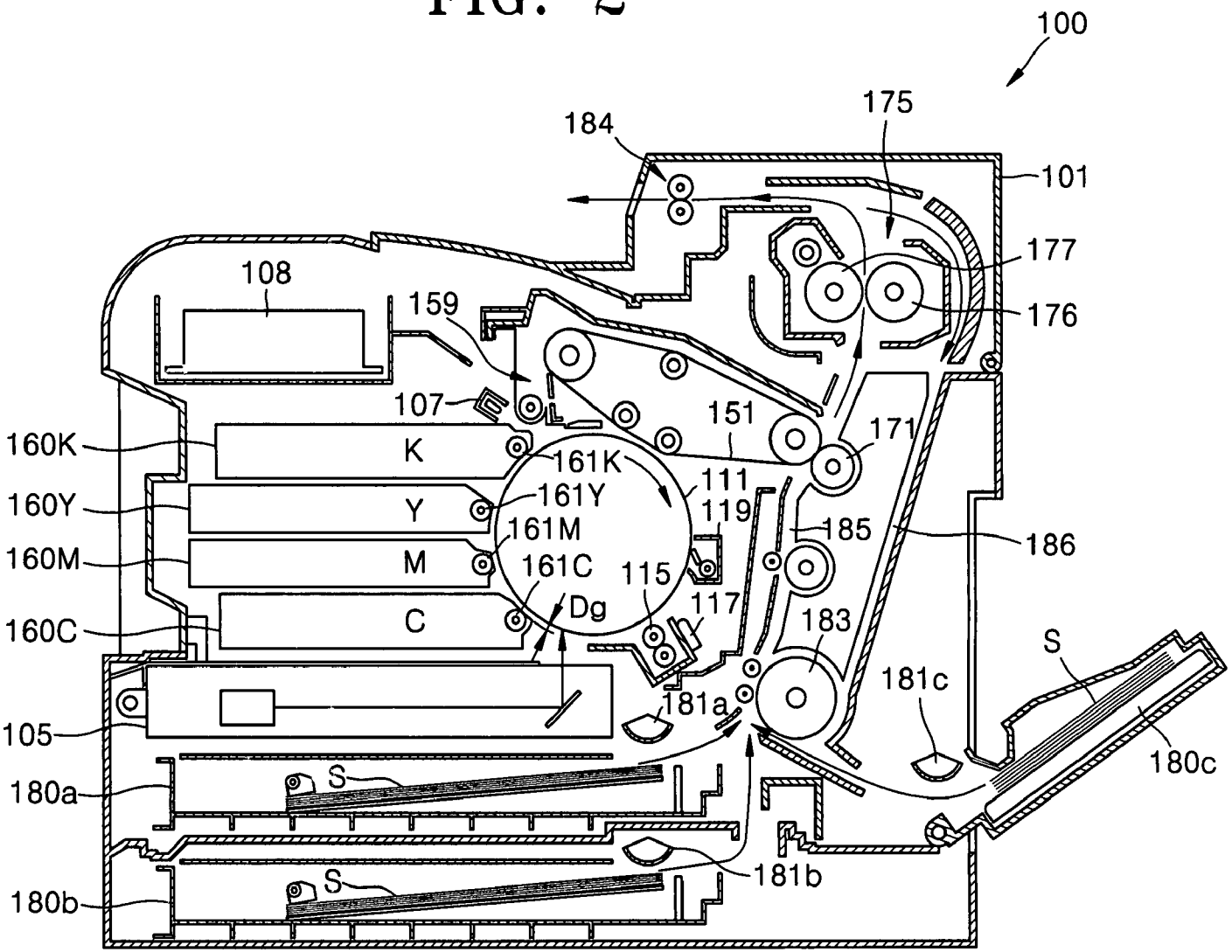
FIG. 2 is a sectional view of an electrophotographic color image forming apparatus according to an embodiment of the present invention.
Figure 3:
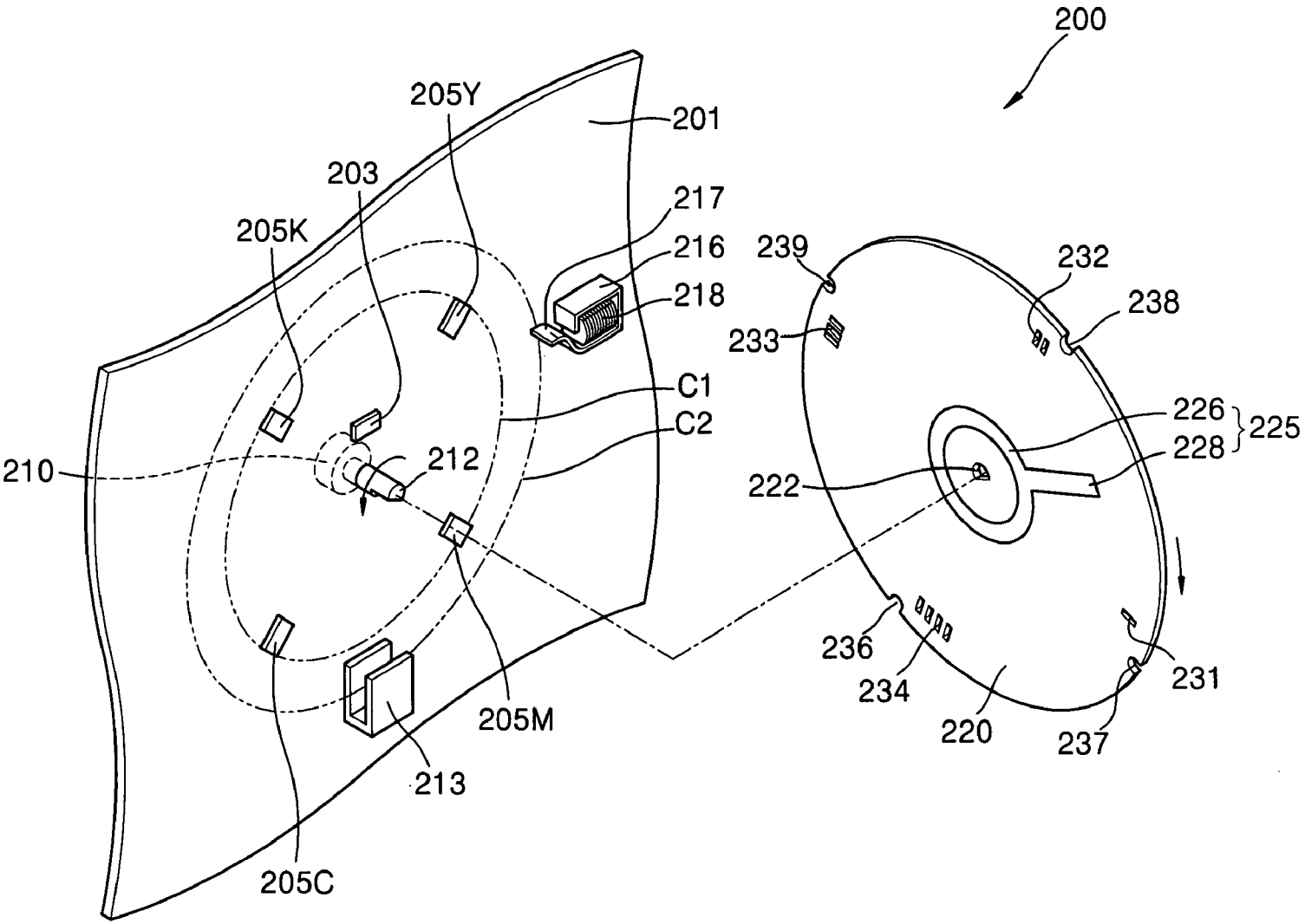
FIG. 3 is an exploded perspective view of a voltage switch according to an embodiment of the present invention.
Figure 4:
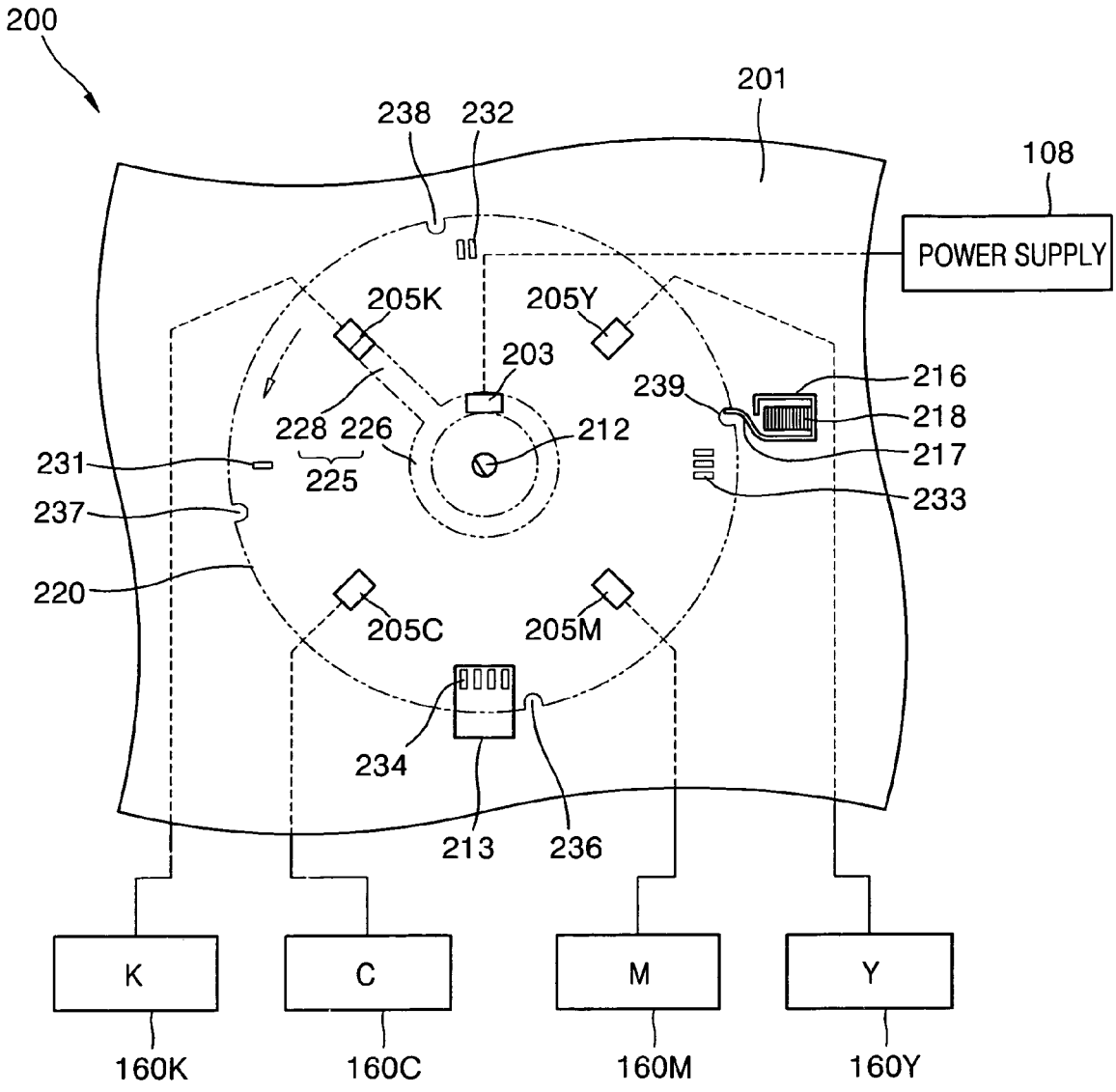
FIG. 4 is a plan view illustrating a circuit board in which an operation of an electrophotographic color image forming apparatus depicted in FIG. 3 is illustrated, specifically, an operation when one of development units is applied with a voltage.
Figure 5:
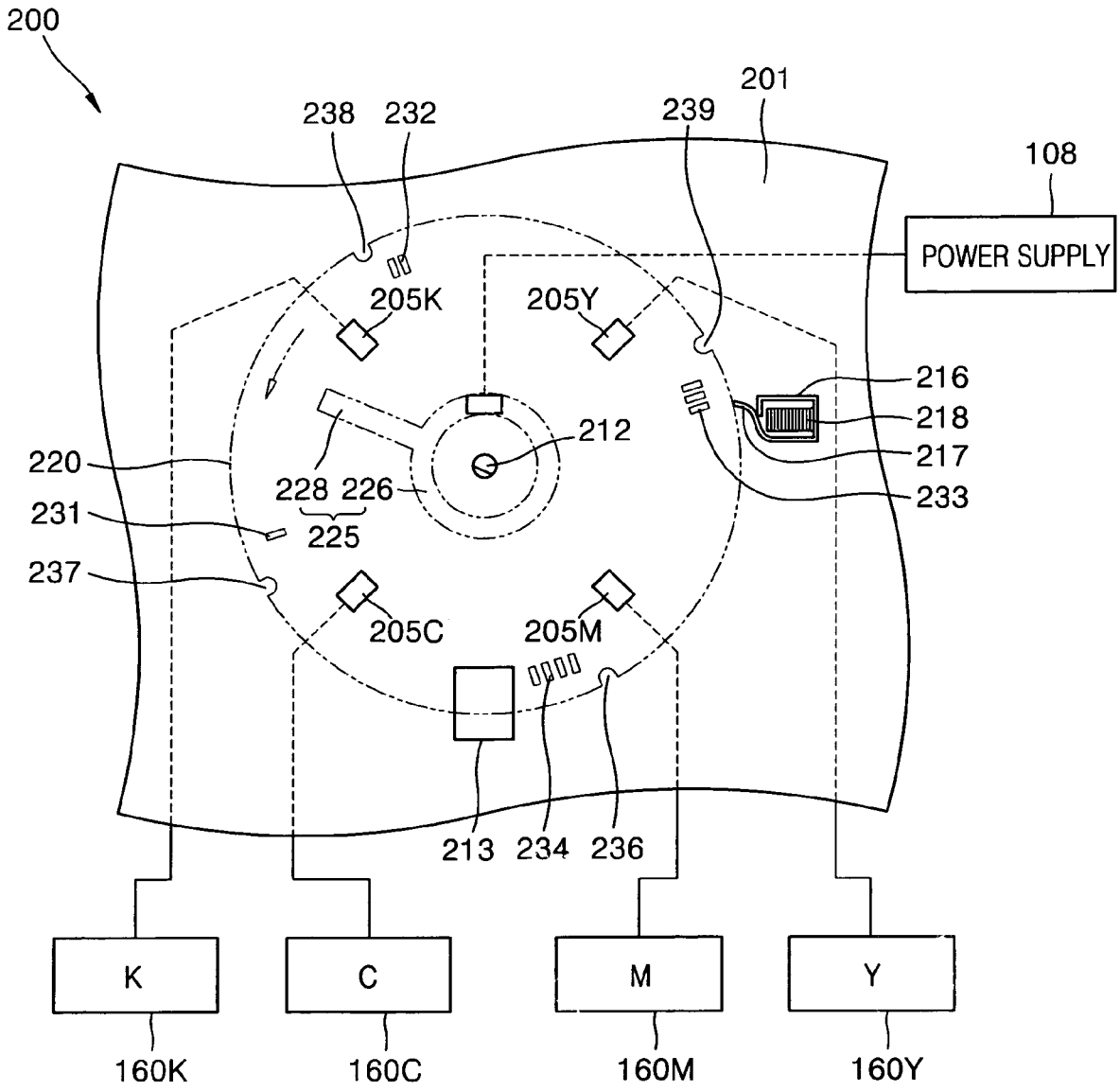
FIG. 5 is a plan view illustrating a circuit board in which an operation of an electrophotographic color image forming apparatus depicted in FIG. 3 is illustrated, specifically, an operation when no development unit is applied with a voltage.

FIG. 2 is a sectional view of an electrophotographic color image forming apparatus according to an embodiment of the present invention, FIG. 3 is an exploded perspective view of a voltage switch according to an embodiment of the present invention, and FIGS. 4 and 5 are plan views illustrating a circuit board in which an operation of an electrophotographic color image forming apparatus depicted in FIG. 3 is illustrated. Specifically, FIG. 4 is a view when one of development units is applied with a voltage, and FIG. 5 is a view when no development unit is applied with a voltage.

Referring to FIG. 2, an electrophotographic color image forming apparatus 100 comprises a case 101 comprising a photoconductor 111, a charge roller 115, a light scanning unit 105, a cyan development unit 160C, a magenta development unit 160M, a yellow development unit 160Y, a black development unit 160K, and a transfer belt 151.

The photoconductor 111 comprises a metal drum and a photoconductive layer formed on the outer surface of the metal drum by using a deposition or similar method. The charge roller 115 is one example of a charger that can be provided, which charges the photoconductor 111 to have a uniform potential. The light scanning unit 105 is installed under the photoconductor 111 to apply light beams to the uniformly charged photoconductor 111, thereby forming an electrostatic latent image corresponding to an image data.

The four development units 160C, 160M, 160Y, and 160K, include cyan (C), magenta (M), yellow (Y), and black (K) powder toners, respectively, and apply these toners to the electrostatic latent image formed on the photoconductor 111 to form visible toner images. The four development units 160C, 160M, 160Y, and 160K, include development rollers 161C, 161M, 161Y, and 161K, respectively, that are located to face the photoconductor 111. The development rollers 161C, 161M, 161Y, and 161K, are spaced to form a development gap (Dg) of several tens to hundreds of micrometers apart from the outer surface of the photoconductor 111. The toners move from the four development units 160C, 160M, 160Y, and 160K, to the photoconductor 111 due to a voltage difference between the photoconductor 111 and the development rollers 161C, 161M, 161Y, and 161K. The voltage difference is called a development voltage or development bias.

Cyan (C), magenta (M), yellow (Y), and black (K) toner images of the photoconductor 111 are sequentially transferred and overlapped on the transfer belt 151 to form a color image. Normally, the length of the transfer belt 151 is longer than or equal to that of a paper (S) on which the color image is finally transferred.

A transfer roller 171 faces the transfer belt 151, and is spaced apart from the transfer belt 151 during the transferring of the toner images from the photoconductor 111 to the transfer belt 151. The transfer roller 171 is then brought into contact with the transfer belt 151 to apply a pressure to transfer the color image from the transfer belt 151 to the paper (S).

To improve a transferring efficiency, a pre-transfer eraser 107 removes electric charge from a non-image area of the photoconductor 111 before transferring the toner image of the photoconductor 111 to the transfer belt 151. Herein, the non-image area of the photoconductor 111 denotes an area where the toner image is not formed.

An erase lamp 117 is another example of such a charge eraser, and removes residual electric charge from the photoconductor 111 before charging the photoconductor 111.

A power supply 108 provides the development bias to apply the toners from the four development units 160C, 160M, 160Y, and 160K, to the photoconductor 111 for forming the toner images. The power supply 108 also provides a first transfer bias to transfer the toner images of the photoconductor 111 to the transfer belt 151 for forming the color image, and provides a second transfer bias to transfer the color image from the transfer belt 151 to the paper (S). Further, the power supply 108 provides a charge bias to the charge roller 115.

A fuser 175 fuses the toners of the color image onto the paper (S), and includes a pair of engaged rollers 176 and 177. The pair of rollers 176 and 177 are provided with a heating element for heating the toners of the color image. While the paper (S) passes through the fuser 175, the toners of the color image of the paper (S) are melted and securely adhered to the paper (S) by the heat and pressure of the fuser 175, thereby completing a color image printing.

A first cassette 180*a* stores the paper (S) to be printed. There can also be a second cassette 180*b* and a third cassette 180*c*. The third cassette 180*c* is usually used for office head paper (OHP) paper or irregular paper.

A feed roller 183 conveys the sheets of paper (S) picked up one by one by a pick-up roller 181*a*, 181*b*, or 181*c*. An eject roller 184 ejects the paper (S) from the case 101. The electrophotographic color image forming apparatus 100 further comprises a feed passage 185 for feeding the paper (S) upwardly from the feed roller 183 to the fuser 175, and also comprises a duplex path 186 for guiding the paper (S) downwardly for a duplex printing operation. After passing the fuser 175, the paper (S) of which one side is printed, is ejected from the case 101 by the eject roller 184. In a duplex printing operation, however, the eject roller 184 rotates in a reverse direction to direct the paper (S) to the duplex path 186, and then the feed roller 183 conveys the returned paper (S) from the duplex path 186 to the feed passage 185 for printing on the other side of the paper (S). Herein, when the paper (S) is directed to the duplex path 186 by the eject roller 184, the paper (S) is inverted for printing on the other side.

A first cleaning unit 119 removes the remaining toner from the outer surface of the photoconductor 111 after the transferring from the photoconductor 111 to the transfer belt 151. Further, a second cleaning unit 159 removes the remaining toner from the transfer belt 151 after the transferring from the transfer belt 151 to the paper (S). The toners removed by the first cleaning unit 119 and the second cleaning unit 159 are conveyed to a waste toner collector (not shown).

An exemplary operation of the electrophotographic color image forming apparatus 100 will now be described in greater detail according to an embodiment of the present invention.

Color image data includes cyan (C), magenta (M), yellow (Y), and black (K) image data. In an embodiment of the present invention, cyan (C), magenta (M), yellow (Y), and black (K) toner images are sequentially transferred to the transfer belt 151, such that the transferred toner images are overlapped on the transfer belt 151 to form a color image. The overlapped color image is then transferred and fused on the paper (S), thereby completing a printing operation.

In a charging operation, the charge roller 115 uniformly charges the outer surface of the photoconductor 111. In an exposing operation, the light scanning unit 105 applies a light beam corresponding to the cyan (C) image data to the uniformly charged photoconductor 111 that is rotating. The light beam causes the photoconductor 111 to have a lower resistance at an area where the light beam is applied, and this causes the area to discharge. Therefore, a voltage difference is generated between the light beam applied area and the remaining area of the photoconductor 111, thereby forming an electrostatic latent image on the photoconductor 111.

In a developing operation, when the rotating photoconductor 111 having the electrostatic latent image and the cyan development unit 160C become closer, the development roller 161C of the cyan development unit 160C starts to rotate. The power supply 108 applies a development bias to the development roller 161C to make the cyan (C) toner move across the development gap (Dg) and adhere to the electrostatic latent image of the photoconductor 111, thereby developing a cyan toner image on the photoconductor 111.

In a transferring operation, the cyan toner image on the photoconductor 111 reaches the transfer belt 151 by a rotation of the photoconductor 111, and the cyan toner image is then transferred to the transfer belt 151 due to the first transfer bias or a contact pressure between the photoconductor 111 and the transfer belt 151.

After the cyan toner image is completely transferred to the transfer belt 151, magenta (M), yellow (Y), and black (B) toner images are sequentially transferred and overlapped to the transfer belt 151 through the same developing and transferring operations.

The transfer roller 171 is spaced apart from the transfer belt 151 until all four toner images are transferred to the transfer belt 151 to form the color image on the transfer belt 151. The transfer roller 171 is then brought into contact with the transfer belt 151 to transfer the color image from the transfer belt 151 to the paper (S).

The paper (S) can be fed from the first cassette 180*a*, second cassette 180*b*, or third cassette 180*c* to arrive at a contact line between the transfer belt 151 and the transfer roller 171 exactly at a time when a leading end of the color image of the transfer belt 151 arrives at the contact line. While the paper (S) passes between the transfer belt 151 and the transfer roller 171, the color image is transferred to the paper (S) due to the second transfer bias. In a fusing operation, the transferred color image is securely bonded to the paper (S) by the heat and pressure of the fuser 175. After these operations, the paper (S) is ejected from the case 101 to complete a printing operation.

Before the next printing operation, the first cleaning unit 119 and the second cleaning unit 159 remove the remaining toners from the photoconductor 111 and transfer belt 151, respectively. The erase lamp 117 applies light to the photoconductor 111 to remove the residual charge.

A voltage switch for connecting the power supply 108 to the four development units 160C, 160M, 160Y, and 160K in sequence to apply a developing bias, will now be described in greater detail.

Referring to FIGS. 3, 4, and 5, a voltage switch 200 includes a circuit board 201, a first terminal 203, four second terminals 205C, 205M, 205Y, and 205K, and a rotor 220. The first and second terminals are provided on the circuit board 201, and the rotor 220 is rotatably installed on the circuit board 201.

The first terminal 203 is electrically connected to the power supply 108, and the four second terminals 205C, 205M, 205Y, and 205K are electrically connected to the four development units 160C, 160M, 160Y, and 160K, respectively. The four second terminals 205C, 205M, 205Y, and 205K, are arranged to form an imaginary circle C1 and are preferably disposed on the circuit board 201 at an angle of 90° therebetween.

The rotor 220 has a circular plate shape and is installed to be rotatable about the center of the circle C1. A step motor 210 which can control a rotation angle, can be provided to drive the rotor 220. The step motor 210 is mounted on one side of the circuit board 201, with its shaft 212 inserted through the circuit board 201 at the center of the circle C1 and protrudes from the other side of the circuit board 201. The protruding shaft 212 is inserted into a hole 222 of the rotor 220, thereby rotatably mounting the rotor 220 on circuit board 201. The diameter of the rotor 220 C2 is larger than that of the circle C1.

The rotor 220 is provided at one side such that a lead 225 is facing the circuit board 201 for electrically connecting the first terminal 203 to the four second terminals 205C, 205M, 205Y, and 205K, in sequence. The lead 225 can be comprised of a metal plate, and includes a ring-shaped portion 226 and a linear portion 228 connected with the ring-shaped portion 226. The center of the ring-shaped portion 226 is located around the hole 222, such that the ring-shaped portion 226 can contact the first terminal 203 regardless of the rotation of the rotor 220. The linear portion 228 contacts the four second terminals 205C, 205M, 205Y, and 205K, in sequence by the rotation of the rotor 220.

The angular displacement of the rotor 220 is detected by a sensing element. The sensing element comprises a first slit 231, second slit 232, third slit 233, and fourth slit 234, that are formed at a peripheral portion of the rotor 220, and also includes an optical sensor 213 for detecting the slits 231 through 234.

The slits 231 through 234 are arranged around the hole 222 of the rotor 220 at an angle of 90° therebetween.

Referring to FIG. 4, when the fourth slit 234 passes through the optical sensor 213 during the rotation of the rotor 220 by the step motor 210 in the direction of the arrow, the optical sensor 213 detects the four slits of the fourth slit 234 and sends a corresponding signal to a controller (not shown) controlling the operation of the voltage switch 200. The controller controls the step motor 210 to stop the rotor 220 when the linear portion 228 contacts the second terminal 205K that is connected to the black development unit 160K. In this manner, when the optical sensor 213 detects the single slit of the first slit 231, the step motor 210 comes to a stop after a predetermined interval to maintain a contact between the linear portion 228 and the second terminal 205C that is connected to the cyan development unit 160C. When the optical sensor 213 detects the two slits of the second slit 232, the step motor 210 comes to a stop after a predetermined interval to maintain a contact between the linear portion 228 and the second terminal 205M that is connected to the magenta development unit 160M. When the optical sensor 213 detects the three slits of the third slit 233, the step motor 210 comes to a stop after a predetermined interval to maintain a contact between the linear portion 228 and the second terminal 205Y that is connected to the yellow development unit 160Y. The predetermined intervals are determined by an angular velocity of the step motor 210, and the angles between the linear portion 228 and the second terminals 205C, 205M, 205Y, and 205K, that are pre-positioned to the linear portion 228 when the slits 231, 232, 233, and 234, pass through the optical sensor 213.

When a motor, of which a rotation angle cannot be controlled, is used for driving the rotor 220 instead of the step motor 210, a stopping element for stopping the rotor 220 can be required. Further, even when the step motor 210 is used as shown in FIGS. 3, 4, and 5, the employment of a stopping element increases reliability in the stopping of the rotor 220. The stopping element comprises first, second, third, and fourth dents 236, 237, 238, and 239, and a stopper 216 that is capable of fitting into the dents for stopping the rotor 220. The stopper 216 is provided with a lever 217 that is urged against the outer circumference of the rotor 220 by an elastic force. Also, the stopper 216 is provided with a solenoid 218 that is capable of retracting the lever 217 from the rotor 220.

The dents 236 through 239 are placed around the hole 222 of the rotor 220 at an angle of 90 degrees therebetween. Referring again to FIG. 4, when the stopper 216 engages the dent 239, the linear portion 228 comes into contact with the second terminal 205K connected to the black development unit 160K. In a similar manner, the other dents 236, 237, and 238, are positioned to allow the linear portion 228 to contact the other second terminals 205C, 205M, and 205Y, in sequence when the other dents 236, 237, and 238, are sequentially engaged by the stopper 216. Therefore, the development units 160K, 160C, 160M, and 160Y, can be sequentially connected with the linear portion 228.

The controller (not shown) for controlling the voltage switch 200 also controls the stopper 216. When one of the dents 236 through 239 is engaged by the lever 217 of the stopper 216, the development bias is applied to a corresponding development unit to develop a corresponding toner image on the photoconductor 111. At the end of the developing of the toner image, the solenoid 218 is supplied with a current to retract the lever 217 and thereby allow the rotor 220 to start to rotate. The developing of the toner image is suspended until the linear portion 228 contacts the next terminal.

To avoid sparks or arcing, the power supply 108 can be controlled to supply the development bias only after the linear portion 228 comes into contact with the second terminal 205C, 205M, 205Y, or 205K, and to stop the supply of the development bias just before the linear portion 228 leaves the second terminal.

A sufficient safety distance can be provided between the first terminal 203 and each of the second terminals 205C, 205M, 205Y, and 205K, to also prevent a leakage (that is, sparking, arcing or any other undesired conductance) of electricity. In one exemplary embodiment of the present invention, the safety distance can be about 5 mm when the power supply 108 supplies the development voltage of up to 3 kV. Also, a sufficient safety distance can be provided between the step motor 210 and the first terminal 203, between the step motor 210 and the second terminals 205C, 205M, 205Y, and 205K, between the optical sensor 213 and the first terminal 203, and between the optical sensor 213 and the second terminals 205C, 205M, 205Y, and 205K, in order to prevent a short circuit.

Since the voltage switch of the embodiments of the present invention has a smaller size than that of the conventional voltage switch, it requires a smaller space for installation, and thereby, the electrophotographic color image forming apparatus can be made to have smaller size.

Further, the voltage switch of the embodiments of the present invention is operated without the expensive solenoids and with fewer parts compared to the conventional voltage switch, thereby reducing cost.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A voltage switch, comprising:

a first terminal disposed on a circuit board and connected to a power supply;

a plurality of second terminals arranged in a circle on the circuit board and connected with a plurality of development units, respectively, wherein each of the plurality of development units holds a different color toner; and a rotor for rotating about the circle on the circuit board to allow the first terminal to be electrically connected with the plurality of second terminals in sequence and comprising a plurality of unique identifiers for the plurality of second terminals, respectively.

2. The voltage switch of claim 1, wherein the rotor comprises:

a lead to connect the first terminal and the plurality of second terminals, wherein the lead comprises a ring-shaped portion being in contact with the first terminal regardless of the rotation of the rotor, and a linear portion connected with the ring-shaped portion to contact the second terminals in sequence by the rotation of the rotor.

3. The voltage switch of claim 1, further comprising a step motor to drive the rotor.

4. The voltage switch of claim 1, further comprising a sensing element to detect an angular displacement of the rotor by sensing at least one of the plurality of unique identifiers.

5. The voltage switch of claim 4, wherein the sensing element comprises:

a sensor, wherein the sensor is sufficiently spaced apart from the first terminal and the plurality of second terminals to prevent a leakage of electricity.

6. The voltage switch of claim 1, further comprising:

a stopping element to stop the rotation of the rotor when the first terminal and any one of the second terminals are connected.

7. The voltage switch of claim 6, wherein the stopping element comprises:

a plurality of detents disposed about an outer circumference of the rotor; and a stopper for engaging the plurality of detents disposed about the outer circumference of the rotor.

8. The voltage switch of claim 1, wherein the first terminal and the plurality of second terminals are sufficiently spaced apart from one another to prevent a leakage of electricity.

9. The voltage switch of claim 1, further comprising:

a motor to drive the rotor, wherein the motor is sufficiently spaced apart from the first terminal and the plurality of second terminals to prevent a leakage of electricity.

10. The voltage switch of claim 1, wherein the plurality of unique identifiers comprises a unique number of grouped slits through the rotor for identifying each of the plurality of second terminals.

11. An electrophotographic color image forming apparatus comprising a photoconductor on which an electrostatic latent image is formed, a plurality of development units each containing different color toner to apply the toner to the photoconductor in order to develop a visible toner image, a power supply for supplying development voltages to the plurality of development units, and a voltage switch for connecting the power supply with the plurality of development units in sequence, wherein the voltage switch comprises:

a first terminal disposed on a circuit board and connected to the power supply;

a plurality of second terminals arranged in a circle on the circuit board and connected with the plurality of development units, respectively, wherein each of the plurality of development units holds a different color toner; and a rotor for rotating about the circle on the circuit board to allow the first terminal to be electrically connected with the plurality of second terminals in sequence and comprising a plurality of unique identifiers for the plurality of second terminals, respectively.

12. The electrophotographic color image forming apparatus of claim 11, wherein the rotor comprises:

a lead to connect the first terminal and the plurality of second terminals, wherein the lead comprises a ring-shaped portion being in contact with the first terminal regardless of the rotation of the rotor, and a linear portion connected with the ring-shaped portion to contact the second terminals in sequence by the rotation of the rotor.

13. The voltage switch of claim 11, further comprising a step motor to drive the rotor.

14. The voltage switch of claim 11, further comprising a sensing element to detect an angular displacement of the rotor by sensing at least one of the plurality of unique identifiers.

15. The voltage switch of claim 14, wherein the sensing element comprises:

a sensor, wherein the sensor is sufficiently spaced apart from the first terminal and the plurality of second terminals to prevent a leakage of electricity.

16. The voltage switch of claim 11, further comprising:

a stopping element to stop the rotation of the rotor when the first terminal and any one of the second terminals are connected.

17. The voltage switch of claim 16, wherein the stopping element comprises:

a plurality of detents disposed about an outer circumference of the rotor; and a stopper for engaging the plurality of detents disposed about the outer circumference of the rotor.

18. The voltage switch of claim 11, wherein the first terminal and the plurality of second terminals are sufficiently spaced apart from one another to prevent a leakage of electricity.

19. The voltage switch of claim 11, further comprising a motor to drive the rotor, wherein the motor is sufficiently spaced apart from the first terminal and the plurality of second terminals to prevent a leakage of electricity.

20. The voltage switch of claim 11, wherein the plurality of unique identifiers comprises a unique number of grouped slits through the rotor for identifying each of the plurality of second terminals.

* * * * *